US005934375A

United States Patent [19]

Peterson

[11] Patent Number: 5,934,375

[45] Date of Patent: Aug. 10, 1999

[54] DEEP WELL SAMPLE COLLECTION APPARATUS AND METHOD

[76] Inventor: Roger Peterson, County Rd. 375, Old Ocean, Tex. 77463

[21] Appl. No.: 08/910,832

[22] Filed: Aug. 13, 1997

[51] Int. Cl.[6] ..... E21B 49/08

[52] U.S. Cl. ..... 166/264; 73/864.34

[58] Field of Search ..... 166/264; 73/864.34, 73/152.23, 152.28

[56] References Cited

U.S. PATENT DOCUMENTS

| | | | |
|---|---|---|---|
| 4,585,060 | 4/1986 | Bernardin et al. | 73/864.34 |
| 4,811,599 | 3/1989 | Johnson et al. | 73/152.23 |
| 4,951,749 | 8/1990 | Carroll | 166/264 |
| 5,293,931 | 3/1994 | Nichols et al. | 166/264 |
| 5,460,224 | 10/1995 | Schalla et al. | 166/264 |
| 5,465,628 | 11/1995 | Timmons | 73/864.34 |
| 5,708,220 | 1/1998 | Burge | 166/264 |
| 5,839,509 | 11/1998 | Peterson | 166/264 |

*Primary Examiner*—William Neuder
*Attorney, Agent, or Firm*—Gunn & Associates, P.C.

[57] ABSTRACT

A deep well system for obtaining artesian samples is set forth. There is a first sample recovery pump which is operated to recover a sample and deliver it to the surface and through a sample flow line. It is surrounded by a packer which is inflated to isolate the region below the sample pump. The sample pump inlet is on the bottom side.

26 Claims, 8 Drawing Sheets

FIG. 1
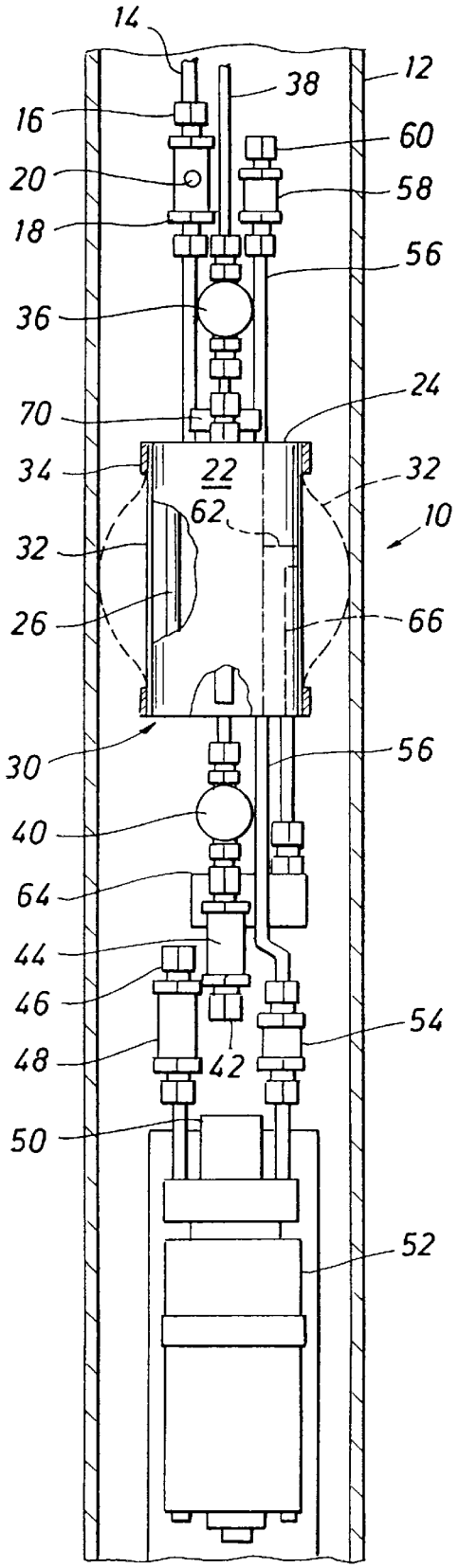
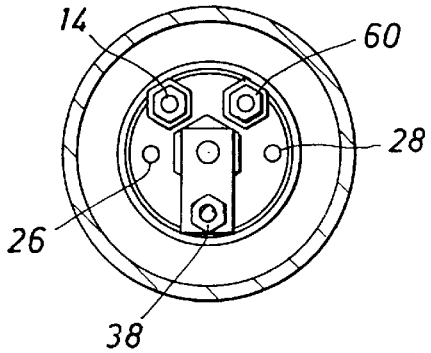
FIG. 2
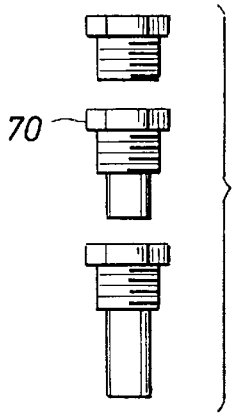
FIG. 3

DEEP WELL SAMPLE COLLECTION APPARATUS AND METHOD

BACKGROUND OF THE INVENTION

The present disclosure is a deep well sample collection apparatus. It is a sample apparatus that enables collection of a specified volume of sample for use in deep well monitoring. In one aspect, it can be used to test the purity of an acquifier. It also can be used to test for leakage of industrial or nuclear waste around a large plant facility. A shallow sample collection apparatus is set forth in co-pending patent application Ser. No. 795,147 which was filed on Feb. 7, 1997. That sample collection apparatus is adapted for sample measurement at shallow depths. Most of the samples that are important in that type of equipment are found just below the surface. Common depths are just a few feet and typically not greater than about 50 feet. By contrast, this disclosure enables the installation of the equipment at depths measured in hundreds or indeed in thousands of feet. In testing a water acquifier for instance, the acquifier may surface in a certain geographic area and slope away to an underground location at lateral distances from it. As greater depths are accomplished, the acquifier might have an overburden of five thousand feet. As a rough rule of thumb, the water pressure is approximately one pound per square inch (psi) for about 26 or 27 inches of water; therefore, a depth of five thousand feet will provide a water pressure of about 2,300 to 2,400 psi. It is difficult to get a test sample off the bottom of that kind of deep well.

The present disclosure sets forth a deep well system which enables sample collection. In particular, it Utilizes a vacuum operated chamber deployed in a deep well which collects and removes a sample in the manner set forth in the above-mentioned co-pending application. That, however, is not enough structure in the sense that it can provide a sample when overburdened at great depths. As the depth increases, great depth and the heavy standing columns of water prevent proper operation and may interfere with sample collection. Moreover, as the depth increases, prevailing pressures at the equipment set forth in the foregoing disclosure are increased. The present apparatus enables sample collection in cooperation with a second pump assure sample delivery and proper turnover in the deep well. This equipment is advantageous for a number of reasons. Among others, this equipment has the advantage of operating at great depths while yet obtaining a sample from the water sampling well. Moreover, as flow goes in and out of the region, the water sample is interchanged and gathering of samples is obtained while trapping of the remaining portion of water in the deep well is avoided. So to speak, water flows by percolation down stream in an acquifier. The acquifier will receive rain at its exposed portion, thereby enabling the water to flow down the slope to greater depths. This migration is carried out through the percolating sand formation and also flows through the deep well. The well is cased, conveniently with a three inch or four inch plastic pipe with a number of perforations in it at different depths. This enables flow of water into and out of the percolating pipe. The perforations permit such an interchange.

The present equipment is especially useful in that it flushes the bottom region of the pipe which lines the well. For example, the well may be cased with four thousand feet of pipe. In the preferred form, it is perforated at many locations except near the bottom. The bottom most portion of about five to ten feet is left without perforations.

So that water does not stagnate at that area, the present apparatus stirs and replaces that water by expelling a portion of it separate from the sample which is taken. This assures that fresh sample collection occurs.

The present apparatus is therefore summarized as including a vacuum operated sample measuring and delivery system. More than that, it also includes and features a bottom located sample input mechanism having a positive displacement pump which assures volumetric turnover in the region of the sample collection pump.

One version is an electric powered positive displacement water pump assisting a vacuum pump. It operates with a packer sleeve which is expanded to isolate a position of the well. The packer sleeve isolates the bottom portion of the well. When the packer inflates the well portion is isolated so that the sample in that area is properly collected and that any remaining portion of the water in that area is expelled for the moment so that turnover can be accomplished.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 1 is a sectional view through a deep sample well showing the vacuum operated sample recovery chamber of the present invention assisted by a positive displacement electric pump;

FIG. 2 is an end view of the sample collection chamber;

FIG. 3 is a view showing alternate plugs which modify the interior cavity of the sample collecting chamber;

DETAILED DESCRIPTION OF THE PREFERRED EMBODIMENT

Figure 4:
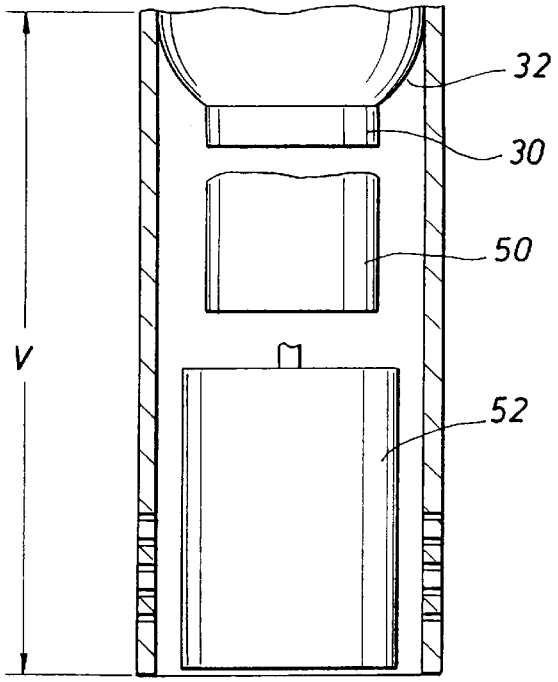
FIG. 4 shows a well bottom support positioning the present apparatus in a cased well above the screen in the well to enable fresh sample circulation.

Attention is directed to FIG. 1 of the drawings where the sample collection apparatus is generally indicated by the numeral 10. It is installed in a deep well having a well liner. The liner 12 is a solid wall pipe from the top to the bottom of the well. It can readily be perforated at many locations or support a screen to admit formation water. The well is typically closed at the bottom end. The equipment 10 is located near the bottom well. Operation of the equipment and details of its construction will begin by tracing the equipment from the top.

A vacuum line 14 extends to the surface through the deep well 12. The line 14 connects with a fitting 16 and then to a cheek valve assembly 18 which is equipped with a hydrophobic check valve element 20. This is normally an air flow line. It is used to assure delivery of a specified sample pumped up from the pump chamber 22. The chamber 22 is a hollow chamber or container holding a specified sample. To recover a sample of 50 cc, the chamber typically will hold about 100 cc of liquid. The chamber 22 is contained within a housing which is closed and sealed at the top and bottom ends. For example, the top end 24 is a closed structure. There is an open passage 26 through the chamber to receive wiring or tubes extending across the structure. There is another isolated passage 28 (FIG. 2). The passages 26 and 28 are connective passages through or across the sample pump mechanism 30 for the equipment located below.

The sample pump 30 is used in conjunction with a resilient sleeve 32 around the exterior. The sleeve 32 is also shown in dotted line to show expansion of the sleeve. When expanded the sleeve 32 aids and assists in defining a plug that functions as a packer in an oil well. It is a packer equipped with the through holes or passages 26 and 28. The holes 26 and 28 extend fully through for communication sake. An encircling strap 34 confines the inflatable sleeve 32 so that it is not pulled free of the ends. Similar straps are located at both ends. This controls or confines sleeve expansion. The sleeve 32 centralizes the pump equipment when the swelling of the expandable sleeve 32 occurs in a controlled fashion.

The vacuum sample pump 30 is operated by a controllable solenoid valve 36. When it opens, it permits fluid flow up through the line 38 which extends to the surface. The line 38 is parallel to the line 14. It delivers the measured or sized sample from the sample chamber.

Briefly, operation of the sample pump 30 occurs in the following manner. A measured quantity of liquid is captured in the chamber 22. It is held for an interval until the solenoid valve 36 is operated. Then, it delivers flow out through the line 38. For that event, the solenoid valve 36 must be opened to deliver the measured amount. The output of the chamber 22 is through the solenoid valve 36 and into the line 38. There is no sample flow out through the line 14. Rather, the line 14 is used to deliver air down and into the chamber 22. This air flow expels the liquid which is delivered. While that is a cursory description of which occurs in that portion of the equipment, a good deal more also occurs and that needs to be added for context.

Filling the chamber occurs through operation of the solenoid valve 40. When it is open, the chamber 22 is then filled from below. Filling, however, occurs through the inlet 42 located below the chamber 22. Water delivered through that inlet is forced by the prevalent down hole pressure to flow through the port 42 and then through the filter 44. The filter 44 is connected serially with the valve 40 and therefore delivers water into the chamber.

That water is delivered from the very bottom of the well. It is desirable to obtain this water to get a bottom located sample. To be consistent, when that sample is delivered up through the chamber of the pump 30, it is metered and measured so that the proper amount is recovered at the surface Continuing with the description of FIG. 1 of the drawings, care should be taken to relate the function of the sample pump 30 with the remainder of the equipment. The apparatus 30 can function with a head of liquid over it of just a few feet. It can be installed in wells which are shallow. It works quite well at shallow depths. However, it is intended to work at much greater depths. While the prevailing head pressure above the device creates a difficult environment, at great depths, the present mechanism is filled without any problems. More specifically, the flow sequence is initiated by the solenoid control valve 40 to thereby admit the sample water through the filter 44. This flow path is therefore from the opening 42, through the filter 44, subject to control by the valve 40 and into the sample pump 30. It is then delivered from the sample pump 30 under control of the solenoid valve 36 into the line 38. The sample pump 30 fills with water to the level which is adequate to fill it. Water filling is limited by the check valve 20 previously mentioned. The check valve is equipped with a hydrophobic element 20 so that the rising water is limited in the check valve. The downward flow of air to expel the sample is delivered through the check valve 20 from the line 14. The measured water quantity from the sample pump 30) is thus delivered out through the line 38 extending to the surface. As will be understood, it is customary to extend the pipe 12 lining the well to the surface, and also to position the lines 14 and 38 in the liner extending to the surface. One surface connected line delivers air flow downwardly to force the liquid out while the sample flows out through the other of the two lines. Note again that the structure includes the through passages 26 and 28 so needed wiring can be extended for control purposes to the various electrically operated valves. For instance, the valve 40 requires an electrical conductor which passes through the passage 26.

Below the sample pump 30, an additional pump 50 is incorporated. The pump 50 is provided with an inlet 46 connected with a filter 48 which delivers water to the pneumatically driven pump 50. The pump 50 is controlled from the surface by air pressure in a flow line which extends through the passage 26. The pump 50 output is delivered under pressure through a check valve 54. Water flows upwardly from the valve 54 through the line 56 to a check valve 58 which has an opening at 60. The pump 50 moves water below the sample pump 30 to be expelled above the sample pump 30. Moreover, because water is pumped with increased pressure over the ambient pressure in this region, it is delivered from the line 56 to a lateral line 62 to inflate the expandable bladder 32 previously identified. Operation of the pump 50 is coordinated with the pressure set points of the check valves 54 and 58. A solenoid valve 64 dumps water from expanded bladder 32. More specifically, the check valve 54 opens at a low pressure differential while the check valve 58 opens at a higher differential pressure. Accordingly, pump 50 and delivers water flow through the valve 54. The pumped water flowing through the check valve 54 inflates the sleeve 32 which moves to the dotted line position. This is accomplished through the lateral passage 62. The pump is operated for a sufficient time to enable the bladder 32 to be properly inflated. The water volume needed from the pump 50 to fill the bladder 32 is fairly consistent. Thus, it typically requires pumping for a fixed interval to obtain the necessary bladder inflation. Assume, for purposes of discussion, that the interval is one minute. Obviously, it can be shorter or longer depending on scale factors. When inflated, the bladder isolates all liquid in the well below the expanded bladder 32. A motor 51 powering said pump 50 is operated for an interval and continues to draw water in from the lower well portions. This will evacuate most of the water from the bottom part of the well. The evacuated water flows through the pump 50, through the line 56 and out through the flitting 60 above the inflated bladder 32 which serves as a packer to isolate this region. Since the pump 50 is held above the very bottom of the well, the vertical height of the packer element 32 above the bottom is well known. The pump 50 is held above the bottom of the well by a spacer 52. In fact, he spacer 52 is better shown in FIG. 4 where only the lower end of the well is illustrated. The pipe 12 in the well is interrupted at the bottom by a set of perforations or a screen to enable the water percolation from the formation in the well. The spacer is sized to be small enough in diameter to insert easily and large enough to reduce the total water volume in the well at V. The packer 32 isolates the volume V in the well below the packer. The net volume V is reduced by the size of the spacer 52. If it is about 93% to 97% of the pipe ID, it reduces water in the volume V. This reduction shortens the pumping time. Proper sampling techniques involve the removal of the volume V after the bladder 32 has been inflated. To be safe, the volume V is pumped out, preferably by three fold or more. An acceptable volume is foul times V; by reducing V, the interval for pumping is decreased. The decrease is related to the size of the spacer 52. Ideal design of the spacer suggests the larger diameter plus height greater than the perforations or screen in the tubing 12. The elevated position of the pump 50 assures water turnover in the volume V and enables artesian water to percolate into the well to refill the volume V.

If the pump 50 is switched off at that time, the bladder 32 is left inflated by virtue of the check valve 54. Evacuation of the bladder is through the solenoid valve 64 connected to the drain line 66.

One advantage of evacuating the volume below the inflated bladder is to permit expulsion of most water in the lower area. Percolation from the artesian sand into the pipe liner 12 is encouraged. While the well is cased with solid wall pipe so that there are no inlets or outlets into the lower end, it is possible to install the screen, at the bottom two, three or four feet. The specific length of screen is subject to choice.

With the solid wall pipe defining a closed chamber, sample stagnation at the well bottom may occur because of a lack of circulation. Because the sample pump 30 defines a narrow gap around the exterior, interchange of water above and below the plug is minimal. The interchange and removal of water is desirable so that a fresh and accurate sample can be obtained. Assume for purposes of discussion that the trace material of interest in the sample changes by one hundred fold in concentration. That change would not be observed because the sample trapped in the well bottom (the nearly closed chamber of the pipe liner 12) would not flow in and out. Therefore, to obtain a fresher sample, it is desirable that the pump 50 be operated for an interval sufficient to exchange all of the water out of this region. Later on, another sample can be taken but it will be a sample that is more representative, i.e., it will not be stagnant sample. Assume in this regard that a sample is taken daily. The operation of the equipment just described requires only a few minutes. Through the use of a 24 hour clock, proper and timed sample operation can be obtained. Moreover, once the sample has been collected, water below the sample pump 30 can be expelled into the space above the pump 30 and fresh water then percolated into the well. That can be ended simply by operating the solenoid valve 64 which permits water to flow in the line 66 out of the bladder, deflating the bladder. Then, the artesian formation fluid drive below the sample pump 30 can be used to advantage because it will force a new sample from the sand into the screened portion of the well. Then, the bladder 32 can be operated again to isolate that particular sample and make the appropriate sample recovery.

FIG. 2 illustrates the passages 26 and 28 through the equipment. They are incorporated to provide communication across the sample pump 30. The equipment shown in FIG. 1 can he modified by the insertion of different plugs 70. They are different in size. The plug 70 enables the volumetric capacity to be adjusted. The plug 70 is especially important to adjustment upwardly or downwardly of the capacity.

Figure 5:
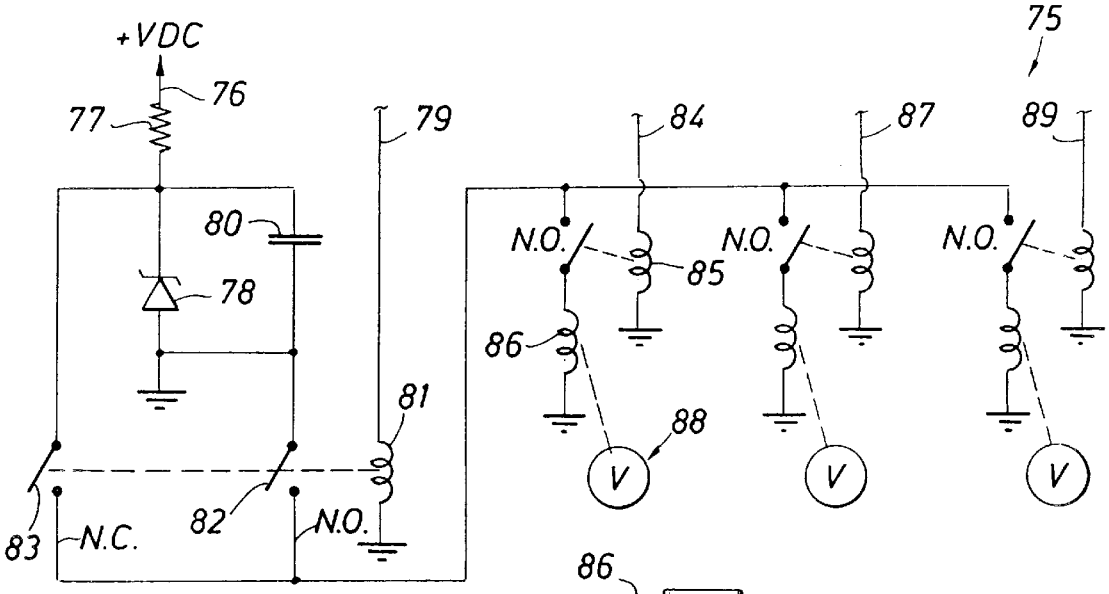
FIG. 5 shows an electrical control system connected to operate three valves to assure timely control.

Attention is now directed to FIG. 5 of the drawings which shows a control circuit for the equipment shown in FIG. 1. The control circuit 75 incorporates a conductor 76 which extends to the surface and provides a current through a series resistor 77 and then through a Zener diode 78. The diode collects a charge on the plates of a charging capacitor 80. The capacitor 80 is substantial in size. It charges to provide power for operation as will be explained. The conductor 79 is input through a relay control coil 81. The coil 81 operates a first set of contacts 82 and a second set of contacts 83. Note the connection of the contacts 82 and 83. While one set is normally open, the other is normally closed. One or the other provides an output by which the capacitor 80 can be discharged.

The control circuit 75 also includes a control line 84 which is input to a relay coil 85. It has a set of contacts which provide power to a coil 86 which is a solenoid for controlling a valve. In this particular instance, the valve is indicated generally by the number 88. Its particular location in the system will be denoted in detail. FIG. 5 replicates this equipment to show air added control line 87 and another control line 89. They operate with the same type of equipment. The three relays are deployed so that they have a normally open position.

Figure 6:
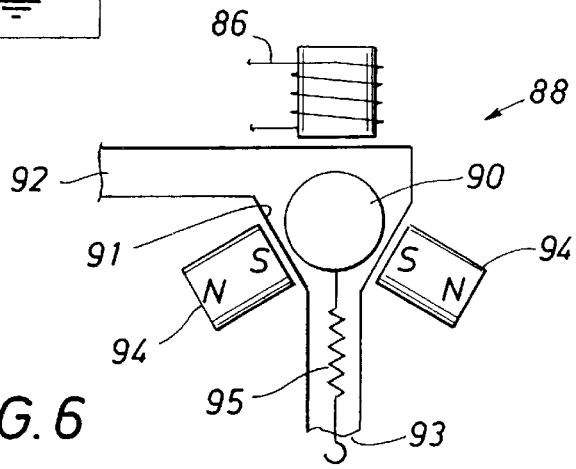
FIG. 6 is a simplified view of a solenoid valve switching to open or close a flow path.

Signals on the conductors 84, 87 or 89 provide for control of the valves 88. Going in greater detail to FIG. 6, the valve 88 is there shown with a valve and valve seat. FIG. 6 incorporates the solenoid winding 86. The solenoid winding 86 creates an electromagnetic attraction for a spherical valve element 90. The valve element is pulled up to an open position for the valve. The valve element 90 is also pulled downwardly in FIG. 6 to a closed position. It closes against a valve seat 91 and prevents flow between the inlet port 92 and the outlet port 93. The valve 88 is operated with a permanent magnet 94 which is replicated on two sides to assure an adequate attraction force serving as a bias for the valve element 90. The valve element 90 is pulled upwardly against the force of a spring 95. The spring 95 is an alternative bias force for the closure of the valve element 90. The magnets, one or more, deployed around the valve seat 91, can be used to provide a normally closed position for the valve element. The valve element 90 is moved in response to two opposing forces. One force pulls it open while the other force pulls the valve element to the closed position. Whether opened or closed, that position is obtained depending on the operative state of affairs for the valve. Whether opened or closed, control can he exercised fully by appropriate adjustment of the forces. For instance the resilient spring 95 can be used to pull the valve to a closed condition, or the system can be inverted so that the steady state bias force is used to hold the valve open. In the latter event, the electrically powered solenoid coil 86 can then be used to pull the valve to a closed condition. As a generalization, in the absence of a signal, the valve is preferably closed and kept closed.

The valve 88 is responsive to an electrical signal applied to it for operation. Now, consider the operation of the equipment so that proper operation is understood. FIG. 5 shows five conductors which extend to the surface. Preferably all five of the conductors are made of very light gauge metal noting it is uncommon to use very small current conductors. It is possible to use very large wire but that crowds the pipe 12 which defines the deep well. In this particular instance, five signal conductors are preferably made of small gauge wire, even as small as thirty gauge wire. Current is continued on the conductor 76 to serve as a trickle charge for accumulating an adequate charge for operation. Charging occurs by collection of a charge on the capacitor 80. No current flows through any of the control circuit components shown in FIG. 5 until a signal is actually applied. For that, the conductors 84, 87 and 89 are preferably quite small and relatively light weight. When current flows through any one of the three, the current is sufficient to cause operation of the connected relay 85. While normally open, they switch to the normally closed condition and provide a signal for operation of the valves 88. This signal is obtained by discharging the capacitor 80 through the solenoid 86 and then to ground. Solenoid resistance determines the duration of that signal. Assume that the aggregate series resistor is adjusted so that the timing is properly controlled. In that instance, the valve 88, represented in general terms in FIG. 5, is structurally the valve shown in FIG. 6. The valve is opened when the valve element is pulled upwardly. Using that as an example, the valve 44 (FIG. 1) is a sample filling valve. It is open to fill the sample container. The sample discharge is delivered through the valve 36 shown in FIG. 1. The valve 64 is the bladder discharge valve. It is operated by the third of the control signals shown in FIG. 5. The three control signals are thus tailored in length to operate the three mentioned valves. The duration of operation is controlled in any suitable fashion. When they operate, they establish control over operation of the pump system so that the air powered pump 50, shown in FIG. 1, is appropriately seated and operated in the desired fashion.

One important aspect of this system is that very small wires are used and there is very little crowding in the well. The five small wires, each being insulated from the other but using thirty gauge wiring, are placed in the well with a minimum of room required. Most of the time, the equipment is off and the only currently flowing is in the conductor 76. The series resistor 77 limits that current so that an appropriate charging current is provided. In like fashion, typically only a short pulse of small current amplitude is delivered over the conductor 79. The remaining three control conductors handle smaller currents; the smaller currents are applied to the relay 85 for short interval(s) and in turn that controls latching of the valve 88. The solenoid 86 carries a larger current. The current is larger than any current which can be delivered to the equipment over the conductors. Because a trickle charge is applied to the capacitor 80, the trickle charge does not require a large diameter conductor while charging is carried out around the clock. Discharge of the capacitor 80 is regulated by the resistance in the solenoid 86 and that is controlled so that an adequate current is delivered. The discharge rate however is limited by increasing the resistor 86 to assure that the valve 88 is operated for the required interval. As noted above, the valve 88 is the solenoid valve which is implemented in FIG. 1 as the valves 44, 36 and 64.

PNEUMATIC SYSTEM

Figure 7:
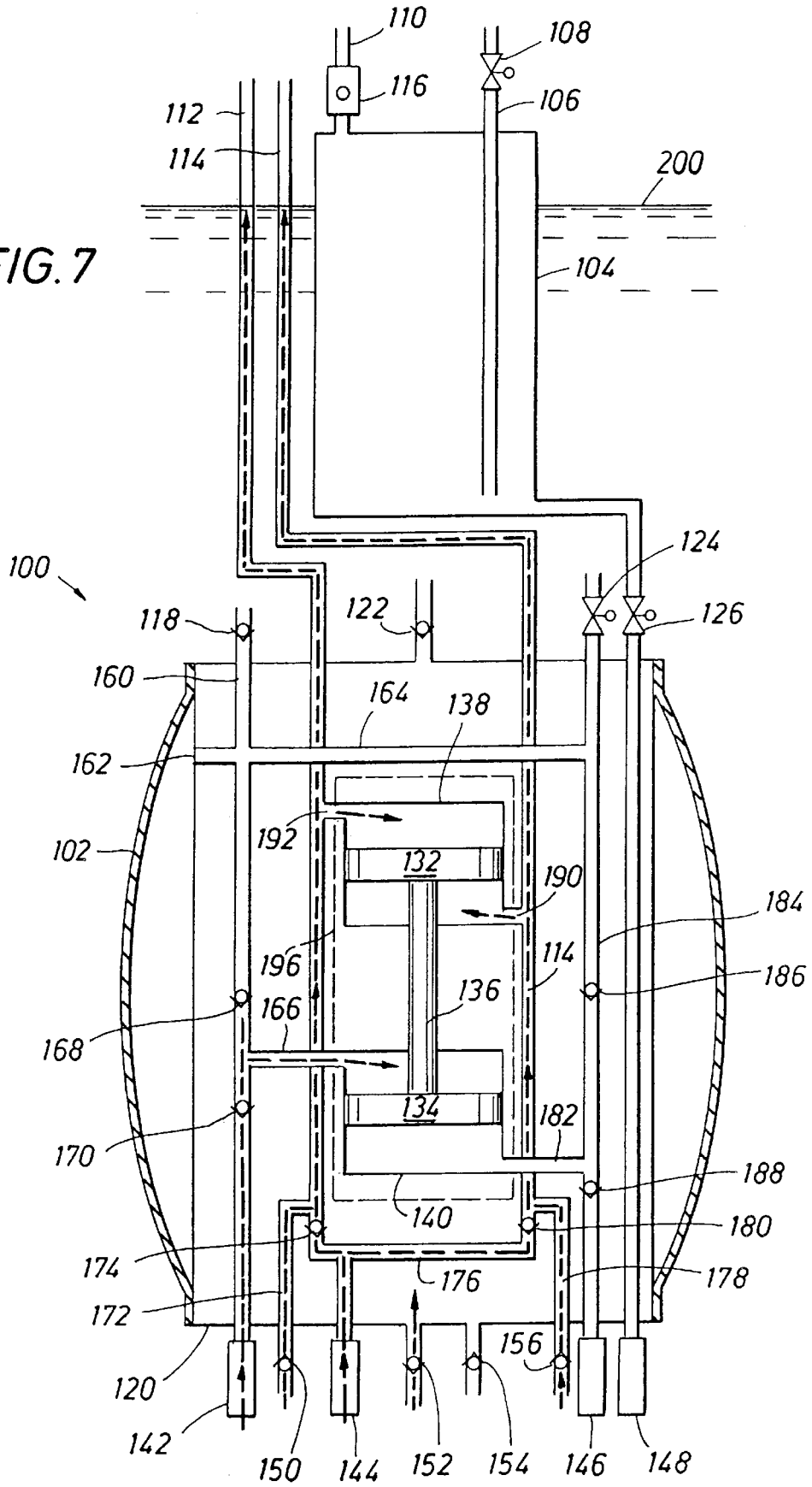
FIGS. 7 to 12 show the flow paths and a sequence of operation in an alternate form of the present invention.

FIGS. 7 through 12 inclusive show a pneumatic system. A description of FIG. 7 will be first provided. Then, a sequence of operations will be provided using all of the views. Reference numerals are assigned to the structure as shown in FIG. 7.

The embodiment shown in FIG. 7 is a unit which is lowered into the cased well and is positioned above the bottom by the apparatus shown in FIG. 4 of the drawings. It is installed at a selected depth. The depth selected should be sufficiently above the screen or perforations to enable artesian water percolation into the area below the apparatus 100. More specifically, the system shown in FIG. 7 comprises an inflatable sleeve 102 which expands to the full line position with inflation. There is a sample pump 104 which is affixed thereabove and which delivers the measured sample of water from the bottom of the well. The sample pump 104 is similar or identical to those in the parent application. The system operates with a sample delivery outlet line 106 through a valve 108 extending to the surface. The valve 108 is controlled in a fashion to be detailed. When operated, it permits delivery of the sample. Another line extending to the surface is the sample vacuum line 110. Additional lines are 112 and 114. The function of all four of these lines will be detailed below. It is noted that the sample vacuum line 110 connects with a valve 116. The valve is a check valve provided with a hydrophobic valve element, i.e., one which is raised on any water in the sample pump. The valve 116, in conjunction with the sample pump 104, work in the same fashion as the embodiment shown in FIG. 1 of the drawings.

The packer is defined by the bladder 102 which is mounted in the same fashion as before. It is mounted on a large cylindrical body 120 which has a number of passages through it and components which operate as will be described. The sample pump 104 is spaced above the cylindrical body 120. The cylindrical body 120 supports the sample pump in a spaced relationship so that the sample pump is operated above the packer but it draws water from below the packer and will be detailed.

There is a second pump inside the body 120 which operates in collaboration with the sample pump as before but it is powered by a different manner. Rather than operate electrically, it is powered by pressure from the surface. The top end of the body 120 supports a purge outlet check valve 118 and an air bleed check valve 122. Additionally, there is a valve 124 for emptying the packer. There is also a sample pump fill valve 126. The valves 108, 124 and 126 are all provided with control signals from the Surface.

Attention is now directed to the interior of the body 120. The dual piston mechanism has a first piston 132 connected to a second piston 134 by a connecting rod 136. The piston 132 is movable within a pump chamber 138 while the lower piston 134 is movable within a similar chamber 140. The chambers 138 and 140 are divided into upper and lower chambers as a result of the respective pistons located in them.

Going now to the lower end of the body 120, it will be observed to include several inlets or passages with the following noted apparatus. There are four filters which arc identified at 142, 144, 146 and 148. They are all connected to appropriate lines to be explained. There is a water drain line which opens through a check valve 150. In addition, there is a water entry check valve 152 which permits water entry for reasons to be explained. There arc additional water drain valves 154 and 156 which operate at different pressures with different connections as will be detailed. All the foregoing components arc located at the lower end of the body 120.

Within the body 120, there are several lines that need to be identified. At the top, there is an outlet line 160 which goes to the exterior of the body via the check valve 1 18 and is emptied above the packer 102. The same line has an outlet 162 into the packer for filling the packer. The line 160 is provided with fluid flow by the line 164 which connects with the controlled valve 124 for draining the packer. The line 160 additionally is provided with pumped water from the line 166 which is delivered into the line 160 through the low pressure check valve 168. Depending on pump stroke, the line 166 fills the chamber 140 with flow introduced through the filter 142 and the check valve 170.

The line 112 at the upper left corner of FIG. 7 extends downwardly into the pump assembly and connects to the chamber 138 at the top end and then connects with the drain valve 150 by the line 172. Water is selectively drawn into this line through the valve 174 and the line 176. The line 176 branches to the filter 144 to admit water. The line 114 descending from the upper left of FIG. 7 is also connected so that the chamber 138 is provided with pressure from that line. The drain line 178 connects to the line 114 which connects with the line 176 through the check valve 180. The lower chamber 140 connects with an outlet line 182 and that in turn connects with the line 184 extending from top to bottom of the body 120, and having check valves 186 and 188 in it. The ports 190 and 192 connect to the upper chamber 138. The dotted line 196 identifies the housing securing the dual cylinder and piston arrangement within the body.

As a generalization, three different strength check valves are used. While structurally the same, they differ only in that they operate at different pressures. The three pressures are low, intermediate and high. The low pressure check valves operate at about one-third psi and that includes the check valves 122, 168, 186, 154, 170, 188, 174, 180 and 152. Check valves operating at about ten psi (an intermediate setting) include the check valves 118. Finally, the check valves 150 and 156 operate at relatively high pressures such as one hundred psi. The latter pressure is selected so that the lines 112 and 114 are protected against over pressure conditions and also release water when removing the equipment from a deep well.

Continuing with FIG. 7, selected lines have been marked to indicate the entrance of water into the equipment as it is lowered from the surface. Assume, as an example, that it is lowered into a well cased to 4,000 feet and the standing column of water is 3,000 feet in the casing. While being lowered, water fills the housing 120 by entry through the valve 152. The water level rises approximately equal in both lines 112 and 114 flowing through the filter 144, and the water level is indicated by the representative water line 200 shown in FIG. 7. As the device is lowered deeper into the water, rising water will fill the lines 112 and 114 to an equal height. It will also fill the chamber 138. While water is received into the body 120, air originally in the body is vented through the check valve 122.

The foregoing describes the situation while the device 100 is lowered into the well. That is an initial condition for operation. Air is forced out as water enters through the check valve 152 at the bottom. This check valve enables the entire body 120 to be filled with water thereby forcing air out of the air bleed check valve 122. Thus, pressure differentials across various tubes and walls of the equipment are avoided and pressure equalization protects the equipment at any depth.

Figure 8:
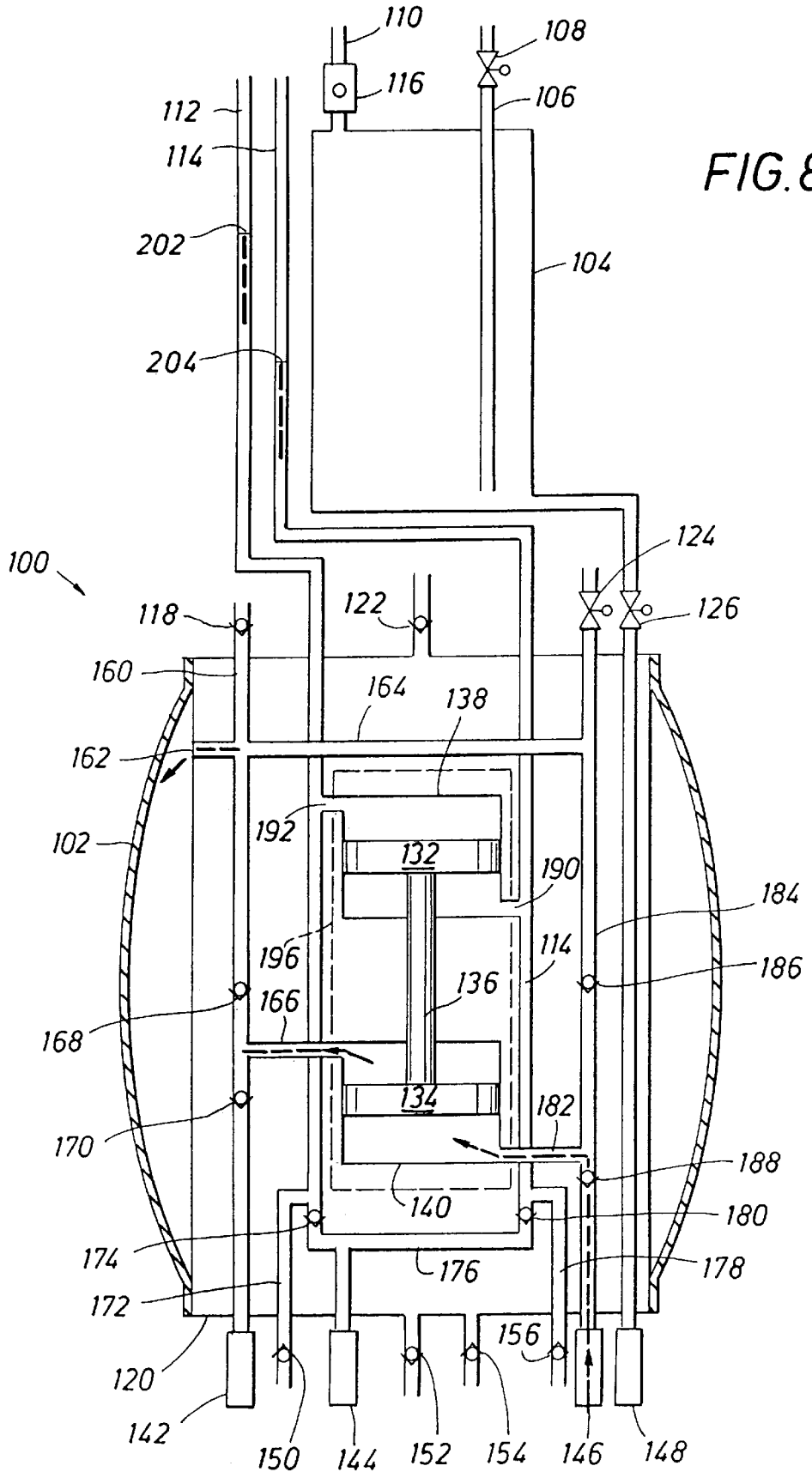

Going to FIG. 8 of the drawings, the lines 12 and 114 are again noted and it should be observed that a different water level is shown in the two lines. The levels 202 and 204 represent pumping from the surface. Starting the pumping action makes the equipment fill with additional water as now described. The lines 112 and 114 extend to the surface. They have water in the bottom portion of the lines. In an unpowered situation, the water in the two lines will rise to the same height. Once the equipment 100 is installed at the bottom, pumping strokes are applied to it by pulsating air in the lines 112 and 114. Air pressure is reciprocated with an adequate stroke to provide a difference in the air in the lines, hence, oscillating the water lines as shown at 202 and 204. The height of the water is raised and lowered, reciprocating in the fashion of a reciprocating engine. This provides a pumping stroke to the piston 132. It is pumped by an increase in pressure above, then below and then above, etc. The stroked piston 134 draws water in through the filter 142 when stroked in one direction and water through the filter 146 when stroked in the other direction. Water is pumped from the chamber 140 into the lines 160 and 184. That ultimately results in the delivery of water through the port 162 into the inflatable bladder 102 and enlarges the packer. This is continued until the packer pressure increases and sets. Again, this is a relative pressure, i.e., an increase over prevailing or ambient pressure. When pressure is greater than ten psi, the check valve 118 opens to remove water from below the packer. Pumping removes the volume V water (see FIG. 4).

Figure 9:
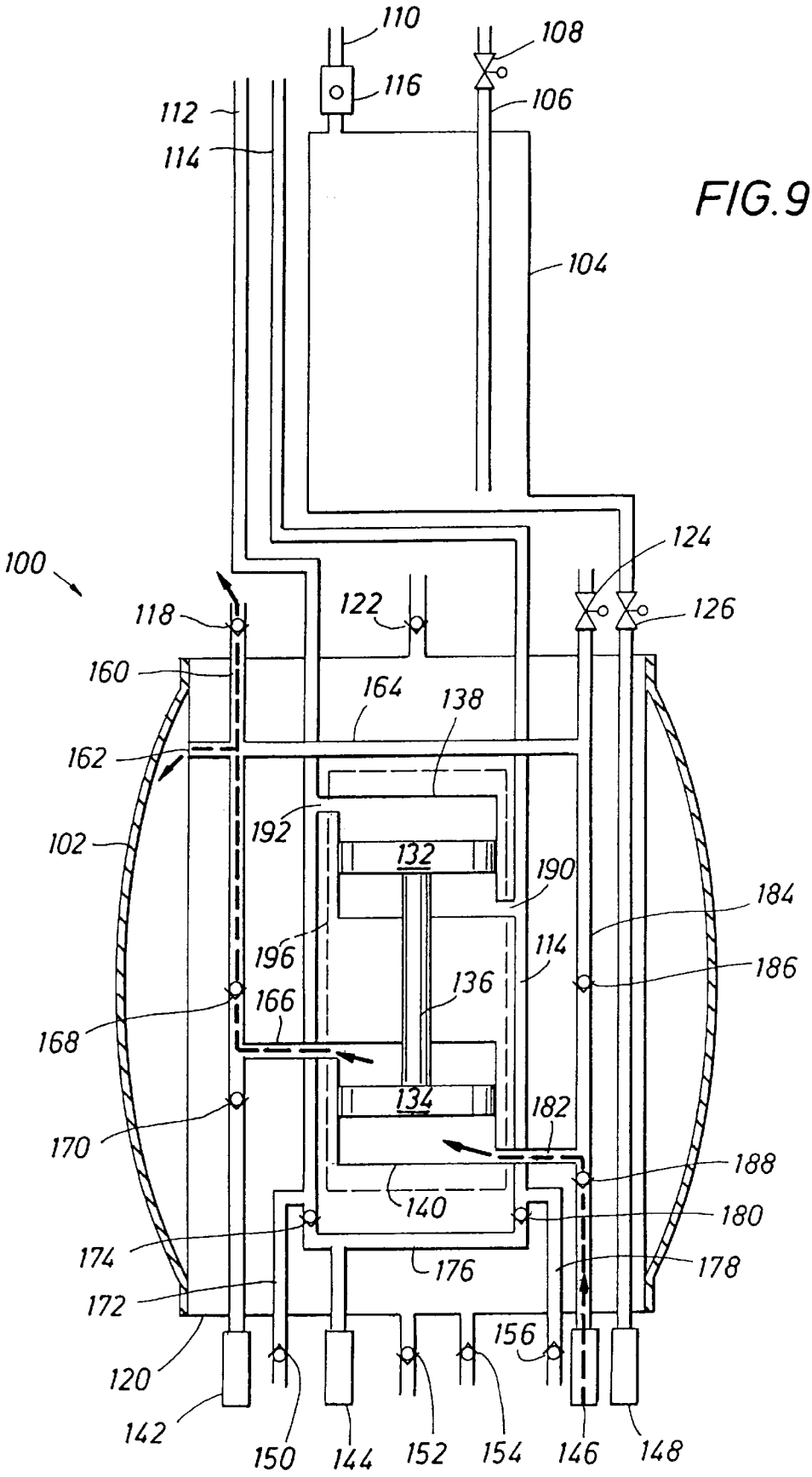

Going now to FIG. 9 of the drawings, it will be observed that pumping is continued until the check valve 118 opens. This opens that check valve and expels pumped water. This is after filling the bladder. As before, the volume V is pumped out three or four times and replaced with fresh water.

Figure 10:
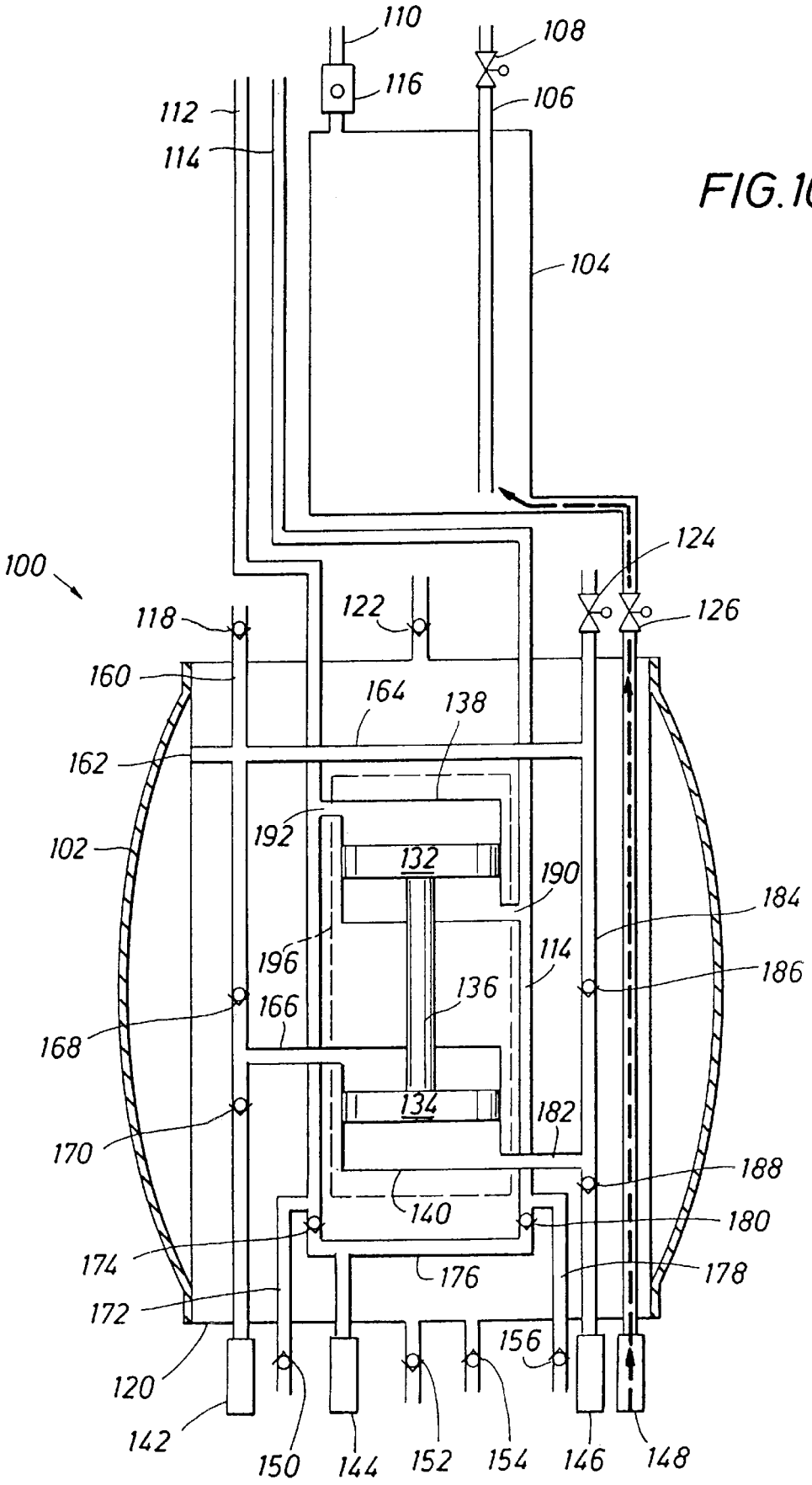
Figure 11:
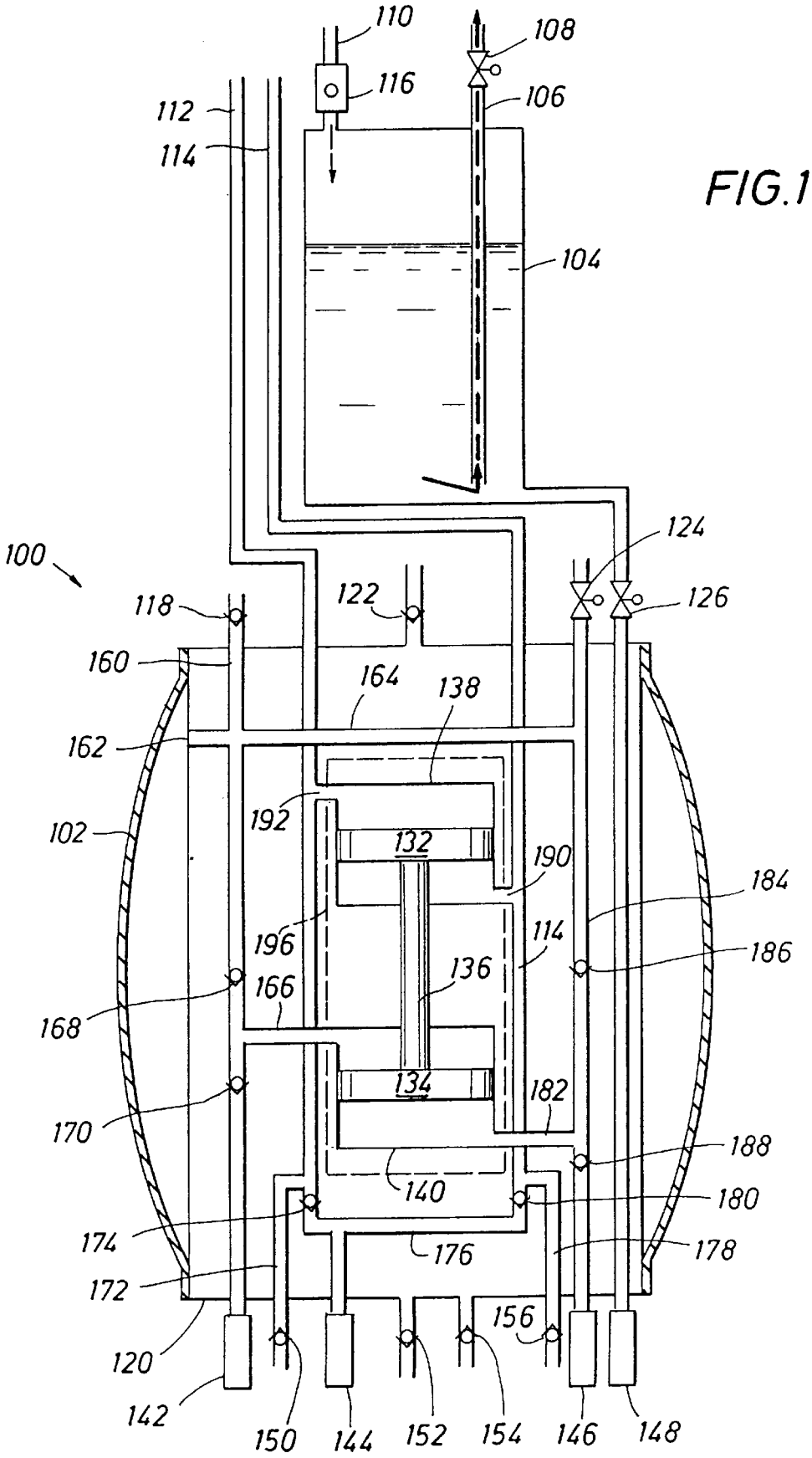

FIG. 10 shows the next step in the sequence of operation. The sample valve 126 is opened, admitting water through the filter 148, and into the sample pump 104 and filling it to the point that the hydrophobic check valve 116 closes. The line 110 assists in fluid transfer by virtue of vacuum on it. That is illustrated in FIG. 10. Going now to FIG. 11, the next step is operation of the sample pump 104. Briefly, air is forced down through the sample line and flows through the valve 116 into the sample pump 104. It forces sample out through the valve 108 which is open so that the line 106 delivers the sample to the surface.

Figure 12:
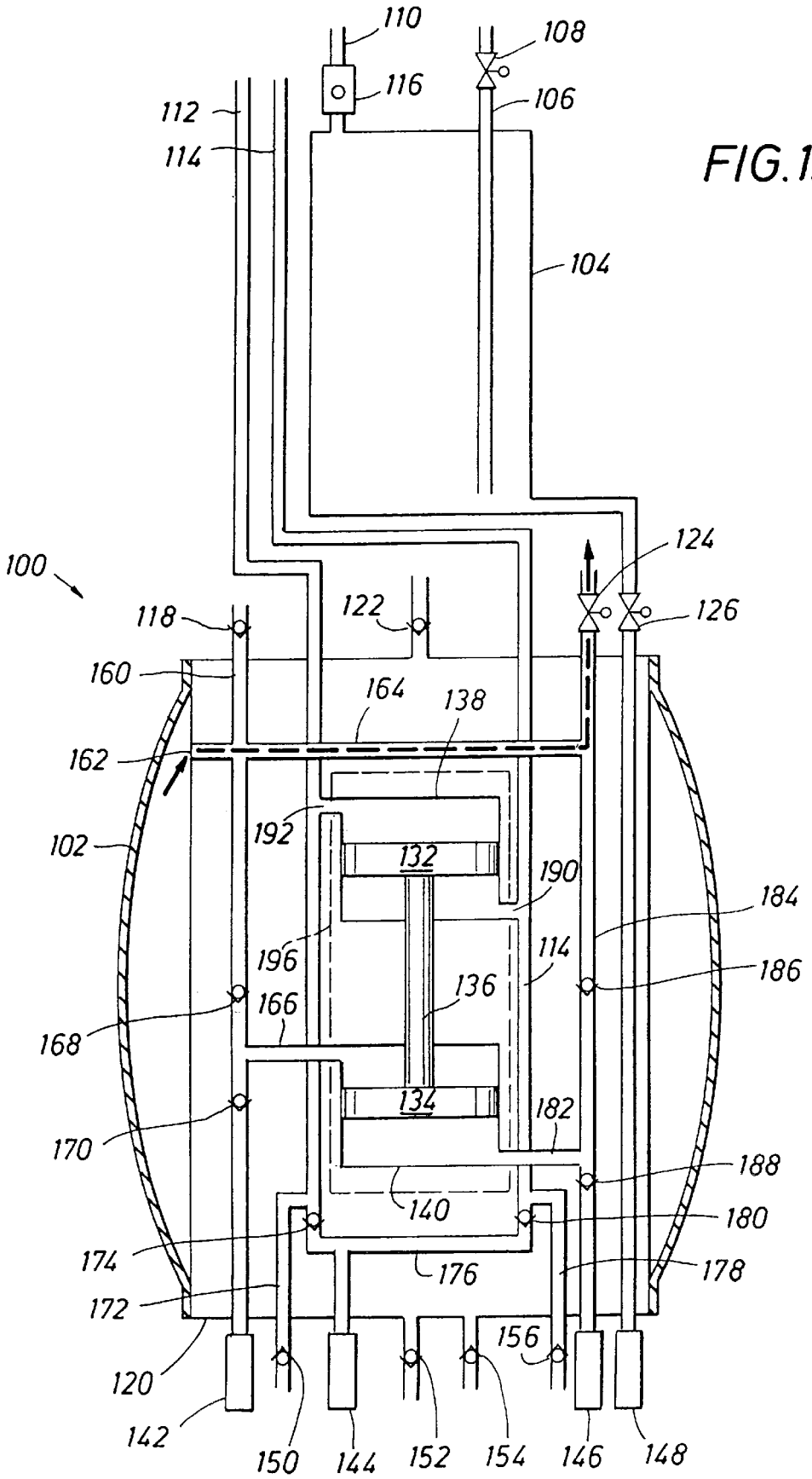

Going now to FIG. 12 of the drawings, the equipment call be readily switched off at which time the bladder 102 collapses to the original size. This is accompanied by opening the packer relief valve 124 which empties water in the packer or bladder to the exterior through that valve. It flows out through the line 164 previously identified.

In addition, FIG. 12 shows how the water drain valves 150 and 156 drain the lines 112 and 114. They arc drained while the equipment is raised to the surface so that the lines 112 and 114 drain through the drain valves just mentioned.

An important aspect of operation of the equipment is turnover of water in the trapped portion of the well below the packer. Going back momentarily to FIG. 9, it shows in particular the purging accomplished by the pump which ejects water through the check valve 118. Water is removed from below the packer to above the packer. This is done so that the volume is turned over, referring again to the volume V mentioned with regard to FIG. 4 of the drawings. That is continued so that the volume is turned over about four times. Again, this is a relatively stable geometric measure which is repeated time and again.

Noting now the operation of the equipment that feature prepares for getting a fresh sample. Pumping through the check valve 118 assures proper water volume turnover prior to taking a sample into the sample pump. That particular step follows the operation shown in FIG. 9 and flow is along the line from below the packer to above, see FIG. 10.

The sequence of operation given above has been described as though the single sample were taken and then the equipment retrieved. In actuality, the equipment can be used to take many time separated samples. Over time, the sequence of operation can be determined by the operator subject to the control as discussed in this disclosure.

While the foregoing disclosure is directed toward preferred embodiments, the scope of the invention is set forth by the claims which follow.

I claim:

1. A sample recovery system for obtaining a sample from a deep artesian well comprising:

a) a sample collection pump sized to pass into and fit into a lined deep well;

b) a second pump positioned in said lined deep well below said sample pump and connected to a flow conduit passing through said sample pump, wherein said second pump is separately operated to i) draw water through an inlet located below the sample pump, and ii) evacuate and deliver such water through an outlet connected to said flow conduit and above said sample pump; and c) a packer isolating said sample pump.

2. The system of claim 1 further comprising:

a) a motor connected to said second pump for operation thereof;

b) a filter connecting said inlet to said second pump; and c a check valve within said flow conduit and between said second pump and said sample pump.

3. The system of claim 2 including a packer connecting line connecting said packer with said flow conduit to fill said packer for inflation.

4. The system of claim 3 wherein said packer connecting line enables packer filling and said packer is also connected to a packer drain line.

5. The system of claim 4 wherein said packer drain line connects to a valve draining said packer and said drain valve is operated in timed fashion.

6. The system of claim 1 wherein said second pump comprises a motor powered pump having said inlet and said outlet and said inlet and outlet are connected to inlet and outlet valves.

7. A method of recovering a water sample from the bottom of a deep well comprising the steps of:

a) operating a sample pump in a deep well including introducing sample from the deep well into an inlet of the pump and recovering the sample through a sample recovery line extending to the surface of the well; and b) periodically and controllably removing water from the inlet of the sample pump by a second pump positioned below said sample pump so that fresh water is circulated near the sample pump inlet.

8. A method of recovering a water sample from the bottom of a deep well comprising the steps of:

a ) operating a sample pump in a deep well including introducing sample from the deep well into an inlet of the pump and recovering the sample through a sample recovery line extending to the surface of the well;

b) periodically and controllably removing water from the inlet of the sample pump so that fresh water is circulated near the sample pump inlet; and c) operating a second pump and inflating a packer through operation of the second pump so that the second pump and packer controllably isolate the bottom of the deep well to enable said periodic removal of water so that the bottom of the well is filled with fresh water thereafter.

9. The method of claim 8 including the added step of periodically operating the second pump to operate the packer by inflating the packer.

10. The method of claim 9 wherein the packer is connected with a filling line and a drain line for said packer, and wherein said second pump is operated to fill said packer, and said packer drain line is periodically opened thereafter to drain said packer.

11. The method of claim 10 including, the added step of filling said packer to thereby inflate said packer and block flow through said deep well adjacent to said packer, and also including the step of operating said second pump to periodically and controllably remove water from the inlet of the sample pump.

12. The method of claim 8 including the step of positioning said second pump below said sample pump and operating said second pump to remove water through said second pump to thereby enable hydrostatic head in the deep well to push additional water into said sample pump inlet in the deep well so that filling of the sample pump is subject to turning over and recirculation of water in the bottom portions of the deep well.

13. The method of claim 8 including the added step of operating said sample pump by pressure delivered through a controlled flow from the surface and through the deep well, and also including the step of timing inflation and deflation of a deep well packer adjacent to the sample pump so that the packer selectively isolates the inlet of the sample pump.

14. The method of claim 11 including the step of also operating the second pump to pump water from below the sample pump so that said second pump removes water from the vicinity of the sample pump.

15. The method of claim 14 wherein said second pump delivers pumped water at an elevated pressure through a first valve to said second pump outlet in the deep well, and also delivers water under pressure through a check valve to inflate said packer.

16. A deep well recovery system for obtaining a sample from a deep well having a substantial pressure head thereon wherein the system is adapted to be lowered into a deep well in a lined well having perforations permitting water flow into the deep well, the system comprising:

a) a sample recovery pump;

b) a deep well pump having an inlet and outlet for moving water in an area from the inlet to the outlet; and c) a packer isolating a portion of the well and positioned between the inlet and outlet of said second pump so that water below said packer is removed by said sample pump and periodically refilled.

17. The system of claim 16 wherein said deep well pump has said inlet below said sample pump, and connects with an outlet line extending to said deep well pump outlet and said outlet line extends through but does not connect with said sample pump.

18. The system of claim 16 wherein said sample recovery pump is powered by a flow line providing an operating flow to said sample pump from the surface and under control at an earth surface of the well, and delivers recovered sample through a sample return line to the surface, and wherein the recovered sample is obtained from below the sample recovery pump.

19. The system of claim 16 wherein said sample recovery pump is surrounded by said packer and supported in said well borehole by said packer so that said packer isolates that portion of the well below said packer and sample recovery pump, and the sample recovery pump comprises an inlet in the isolated portion of the well.

20. The system of claim 16 comprising a filter serially connected with an inlet communicating to said sample recovery pump from that portion of the well below said sample recovery pump.

21. The system of claim 16 wherein said sample recovery pump is contained within a cylindrical structure and said packer comprises an inflatable resilient member therearound, and said packer, on inflation, centralizes said sample recovery pump in the well and blocks the well against flow on the exterior of said cylindrical sample recovery pump.

22. A sample recovery system for obtaining a sample from a deep artesian well comprising:

a) a sample collection pump sized to pass into and fit into a lined deep well;

b) a second, pneumatic pump positioned in said lined deep well below said sample pump and connected to a flow conduit passing through said sample pump, wherein said second pump is separately operated to i) draw water through an inlet located below the sample pump and ii) evacuate and deliver such water through an outlet connected to said flow conduit and above said sample pump; and c) a packer isolating said sample pump.

23. The system of claim 22 further comprising:

a) a pneumatic motor connected to said second pump;

b) a filter connecting said inlet to said second pump; and c) a check valve within said flow conduit and between said second pump and said sample pump.

24. The system of claim 23 including a packer connecting line connecting said packer to said flow conduit to fill said packer for inflation wherein said packer line enables packer filling and said packer is also connected to a packer drain line and wherein said packer drain line connects to a valve draining said packer and said drain valve is operated in timed fashion.

25. The system of claim 22 wherein said second pump is connected to a motor and said pump and motor jointly comprise:

(a) a pair of spaced pistons;

(b) a cylinder around each of said pistons;

(c) a piston rod connecting said pistons so that piston movement is in unison; and (d) a pair of lines connected to deliver alternating fluid pressure peaks to one of said pistons to reciprocate said piston for pumping by said second pump.

26. The system of claim 25 wherein said pair of lines connect up the well for alternating fluid pressure peaks.

* * * * *